US012465834B2

(12) United States Patent
Wu

(10) Patent No.: US 12,465,834 B2
(45) Date of Patent: Nov. 11, 2025

(54) PUNCHING TRAINING DEVICE

(71) Applicant: Azuni International Co., Ltd., Taichung (TW)

(72) Inventor: Li-Lan Wu, Taichung (TW)

(73) Assignee: AZUNI INTERNATIONAL CO., LTD., Taichung (TW)

( * ) Notice: Subject to any disclaimer, the term of this patent is extended or adjusted under 35 U.S.C. 154(b) by 184 days.

(21) Appl. No.: 18/363,353

(22) Filed: Aug. 1, 2023

(65) Prior Publication Data

US 2025/0041695 A1 Feb. 6, 2025

(51) Int. Cl.
*A63B 69/22* (2006.01)

(52) U.S. Cl.
CPC ..... *A63B 69/222* (2022.08); *A63B 2209/02* (2013.01); *A63B 2225/093* (2013.01); *A63B 2244/102* (2013.01)

(58) Field of Classification Search
CPC ..... A63B 69/20; A63B 69/22; A63B 69/222; A63B 69/224; A63B 2071/023; A63B 2071/026; A63B 2209/00; A63B 2209/02; A63B 2225/09; A63B 2225/093; A63B 2244/10; A63B 2244/102; A63B 2244/106
See application file for complete search history.

(56) References Cited

U.S. PATENT DOCUMENTS 318,766 A * 5/1885 Longden ..... A63B 69/30 482/89
410,475 A * 9/1889 Widger ..... A63B 69/224 482/90
426,944 A * 4/1890 Lovatt ..... A63B 69/30 482/89
519,918 A * 5/1894 MacLearn ..... A63B 69/224 482/90
524,894 A * 8/1894 Forsberg ..... A63B 69/224 40/608
547,730 A * 10/1895 MacLearn ..... A63B 69/224 248/583
547,731 A * 10/1895 MacLearn ..... A63B 69/224 211/33
565,747 A * 8/1896 Hawthorne ..... A63B 69/22 482/87
602,517 A * 4/1898 McFadden ..... A63B 69/222 248/163.1

(Continued)

FOREIGN PATENT DOCUMENTS

AU 8960491 A * 6/1992
CN 111617496 A * 9/2020

(Continued)

*Primary Examiner* — Gary D Urbiel Goldner

(74) *Attorney, Agent, or Firm* — Muncy, Geissler, Olds & Lowe, P.C.

(57) ABSTRACT

A punching training device includes: a base; a supporting assembly including a fixed rod and a telescopic rod, the fixed rod connected to the base, the telescopic rod being detachably connected to the fixed rod, the telescopic rod being retractable in an axial direction of the fixed rod relative to the fixed rod; and a punching assembly including an elastic rod and a strike body, the elastic rod being detachably connected to the telescopic rod, the elastic rod being made of elastic material, the strike body being disposed on the elastic rod.

10 Claims, 8 Drawing Sheets

(56) References Cited

U.S. PATENT DOCUMENTS 1,890,696 A * 12/1932 Rosenhahn ..... A63B 69/224 482/90
2,186,403 A * 1/1940 Bullis ..... A63B 69/224 482/90
2,642,287 A * 6/1953 Rubin ..... A63B 69/222 482/90
3,022,072 A * 2/1962 Zinnow ..... A63B 69/224 446/490
5,607,377 A * 3/1997 Wilkinson ..... A63B 69/222 482/30
5,674,157 A * 10/1997 Wilkinson ..... A63B 69/22 482/83
7,070,520 B1 * 7/2006 An ..... A63B 69/0091 473/149
7,704,194 B1 * 4/2010 Chen ..... A63B 69/224 482/90
7,766,799 B1 * 8/2010 Chen ..... A63B 69/224 482/85
7,927,260 B1 * 4/2011 Stalka ..... A63B 69/30 482/84
9,114,298 B2 * 8/2015 Ruggiero ..... A63B 69/20
9,265,997 B1 * 2/2016 Good, Jr. ..... A63B 57/00
9,782,651 B2 * 10/2017 Ruggiero ..... A63B 69/0084
11,471,739 B2 * 10/2022 Wu ..... A63B 71/023
11,745,073 B2 * 9/2023 Chen ..... A63B 69/224 482/90
2002/0198085 A1 * 12/2002 Wang ..... A63B 69/20 482/89
2011/0251024 A1 * 10/2011 Hu ..... A63B 69/224 482/90
2012/0135843 A1 * 5/2012 Goldy ..... A63B 69/224 482/90
2012/0149534 A1 * 6/2012 Fu ..... A63B 69/22 482/90
2013/0324372 A1 * 12/2013 Cuadrado ..... A63B 69/224 482/90
2014/0302969 A1 * 10/2014 Chen ..... A63B 69/224 482/90
2015/0182833 A1 * 7/2015 Hu ..... A63B 69/224 482/87
2020/0155914 A1 * 5/2020 Hu ..... A63B 69/224
2022/0040552 A1 * 2/2022 Huang ..... A63B 24/0062
2023/0010539 A1 * 1/2023 Chen ..... A63B 69/22
2025/0041696 A1 * 2/2025 Wu ..... A63B 69/224

FOREIGN PATENT DOCUMENTS

GB 951042 A * 3/1964
KR 200302630 Y1 * 1/2003
KR 200441378 Y1 * 8/2008
KR 20160001386 U * 4/2016
KR 102312268 B1 * 10/2021
TW I606857 B 12/2017
TW I685367 B 2/2020
TW I699230 B 7/2020

* cited by examiner

PUNCHING TRAINING DEVICE

BACKGROUND OF THE INVENTION

Field of the Invention

The present invention relates to a punching training device.

Description of the Prior Art

Boxing has become very popular in recent years. Boxing is a high-intensity exercise that combines aerobic and muscle training, and it can effectively train the muscles of the whole body, strengthen the core muscles, enhance cardiopulmonary function, improve coordination and reaction speed, release stress, and reduce stress and anxiety. The striking training device allows the user to practice striking skills and train reaction alone without an accompanying person. Generally, a striking training device includes a base, a rod body, a spring and a strike portion. The spring is connected to and between the strike portion and the rod body. When the user strikes the strike portion, the spring can make the strike portion swing and return. The like striking training devices are disclosed, for example, in TW 1699230, TW 1685367 and TW 1606857.

However, this type of striking training device is restored through a spring, and the strike portion usually swings with the spring as a fulcrum, resulting in a narrow swinging range of the strike portion so that it is seriously lack of responsive speed and sensitivity, and can no longer meet the needs of striking training.

The present invention is, therefore, arisen to obviate or at least mitigate the above-mentioned disadvantages.

SUMMARY OF THE INVENTION

The main object of the present invention is to provide a punching training device which provides various rebounding and swinging ranges, speeds and heights, and provides more variety of training modes.

To achieve the above and other objects, a punching training device is provided, wherein the punching training device includes: a base; a supporting assembly including a fixed rod and a telescopic rod, the fixed rod connected to the base, the telescopic rod being detachably connected to the fixed rod, the telescopic rod being retractable in an axial direction of the fixed rod relative to the fixed rod; and a punching assembly including an elastic rod and a strike body, the elastic rod being detachably connected to the telescopic rod, the elastic rod being made of elastic material, the strike body being disposed on the elastic rod.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
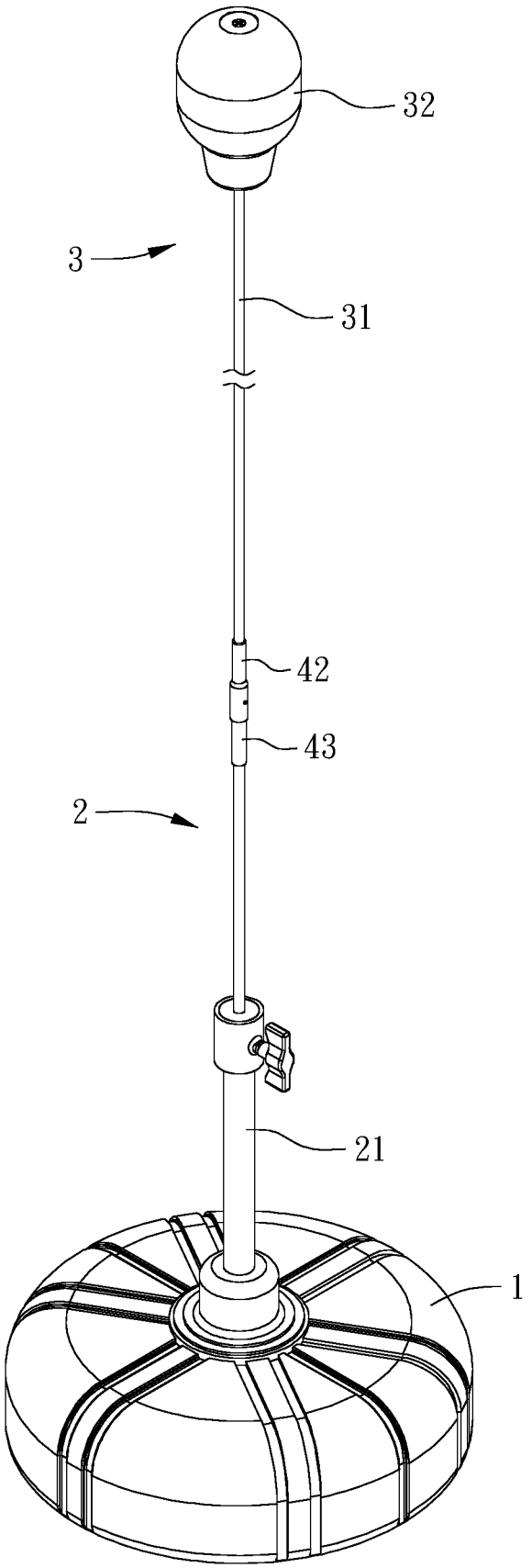
FIG. 1 is a stereogram of an exemplary embodiment of the present invention.
Figure 2:
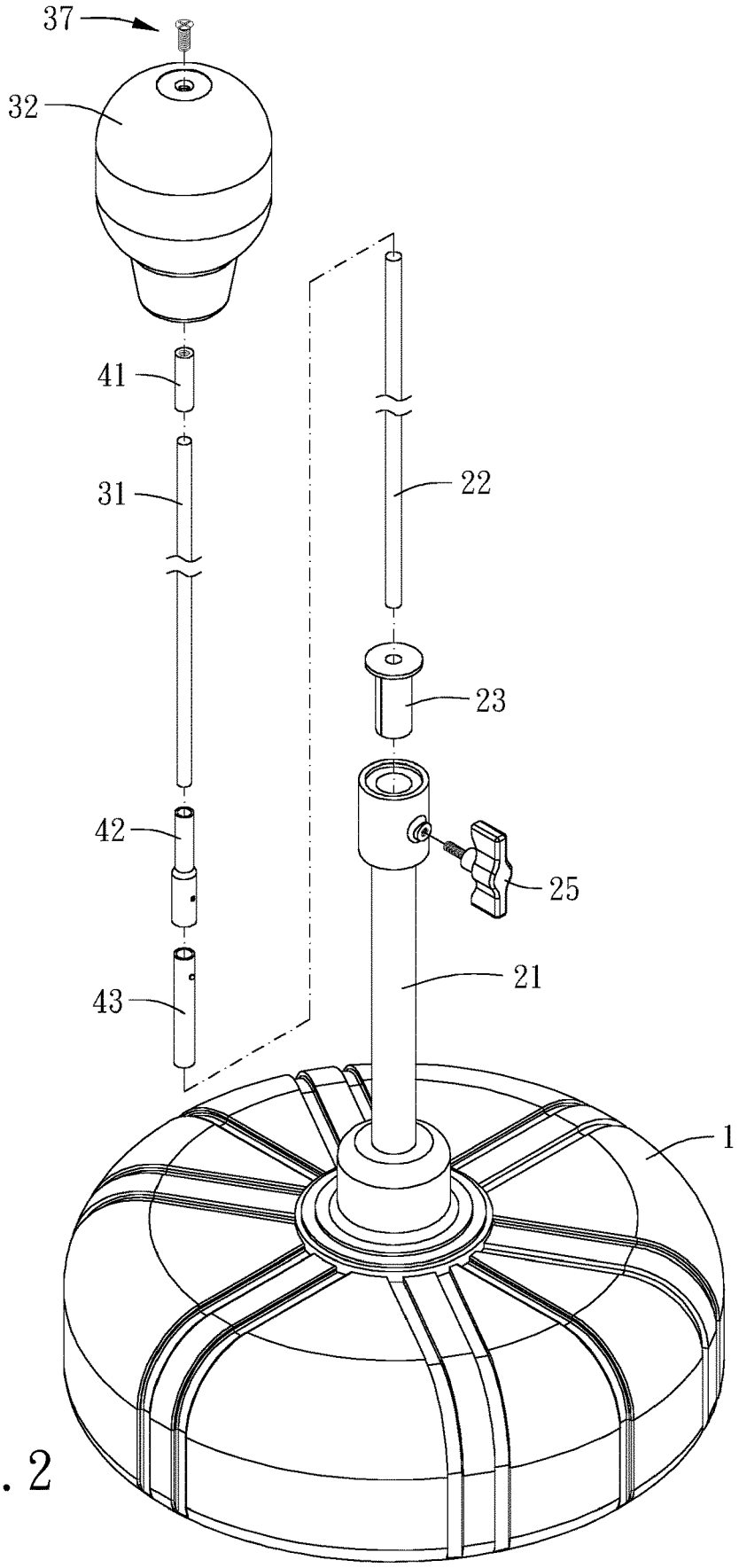
FIG. 2 is a breakdown drawing of an exemplary embodiment of the present invention.
Figure 3:
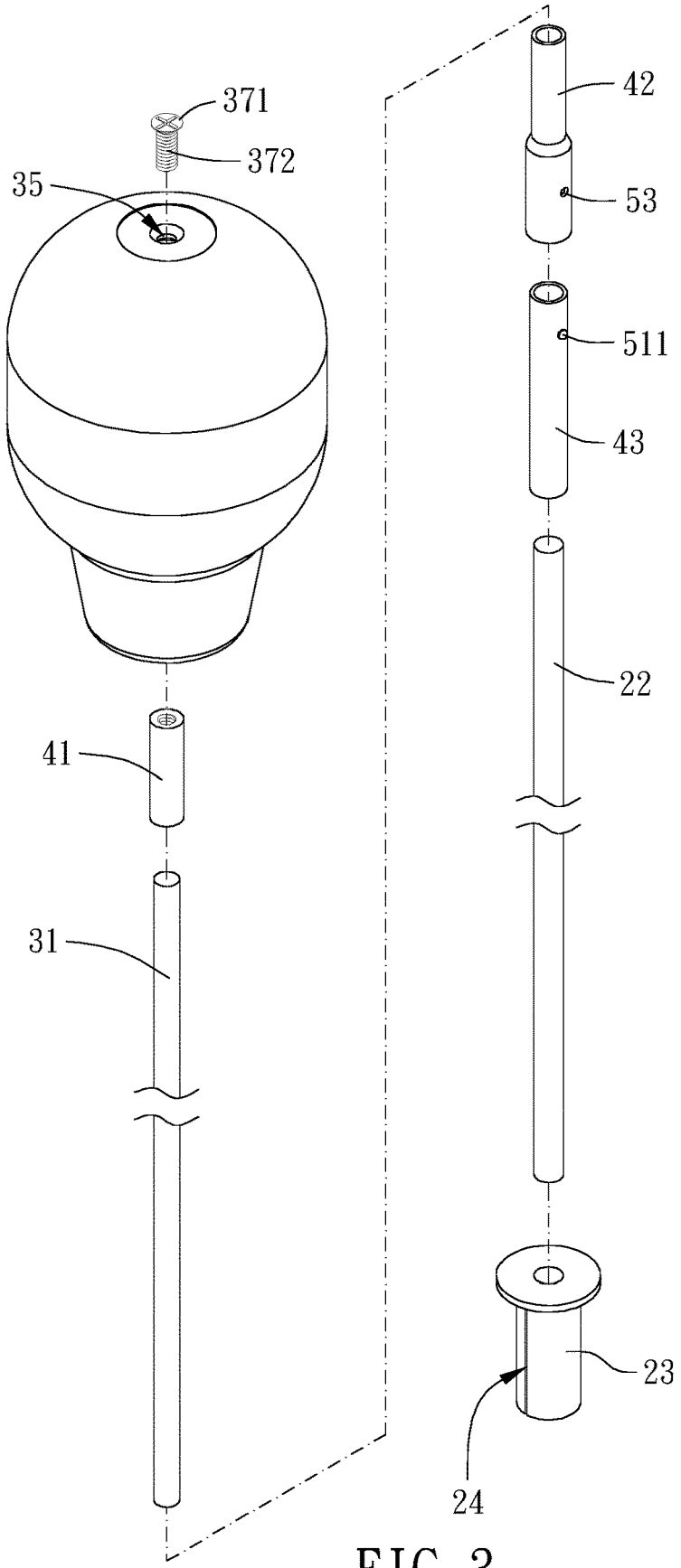
FIG. 3 is a partial enlargement of FIG. 2.
Figure 4:
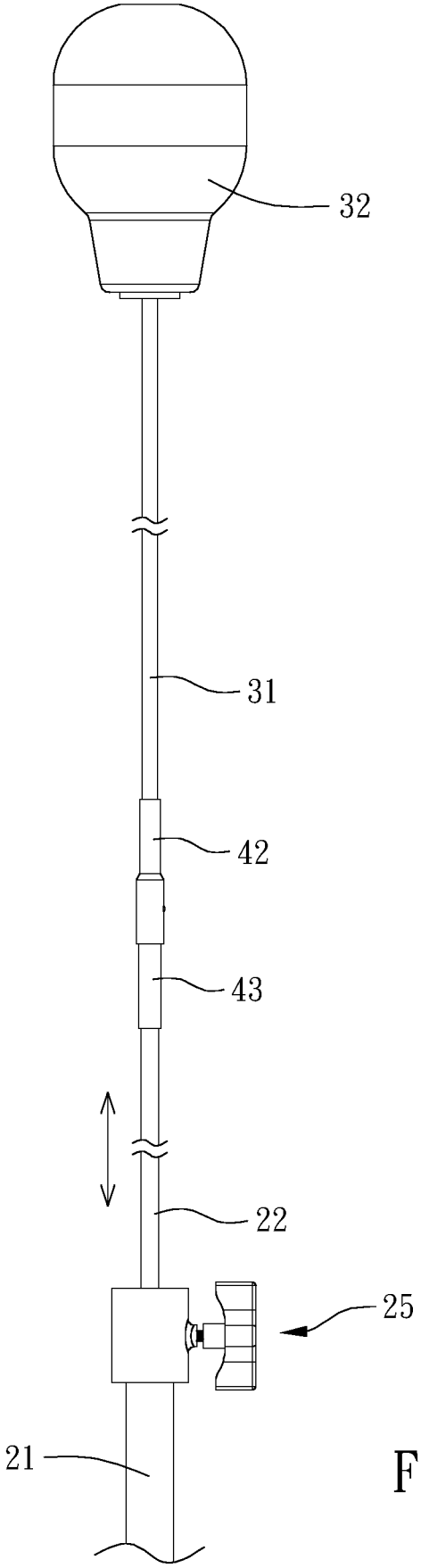
FIG. 4 is a drawing showing a retraction operation of an exemplary embodiment of the present invention.
Figure 5:
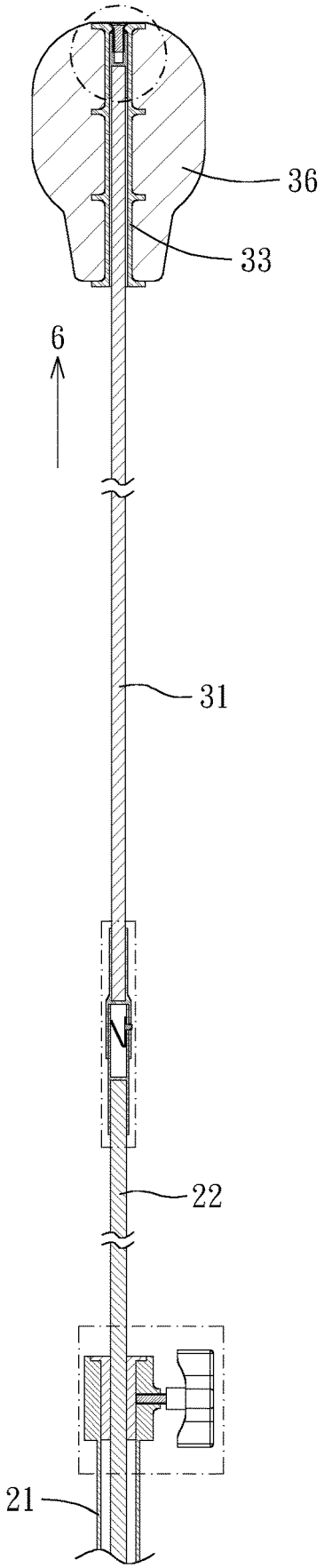
FIG. 5 is a cross-sectional view of FIG. 4.
Figure 6:
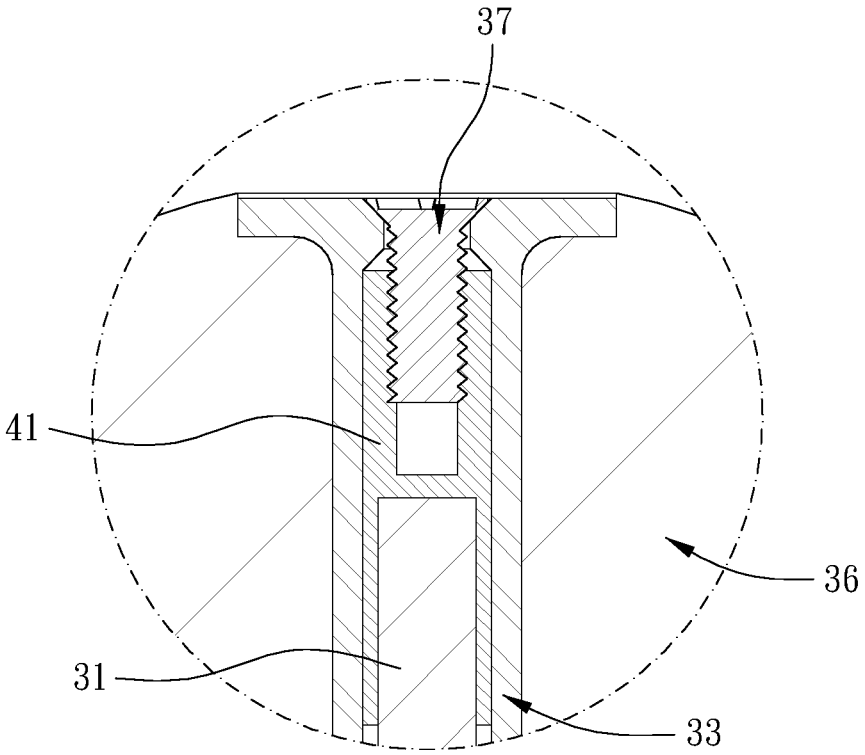
FIG. 6 is a partial enlarged cross-sectional view of an exemplary embodiment of the present invention.
Figure 7:
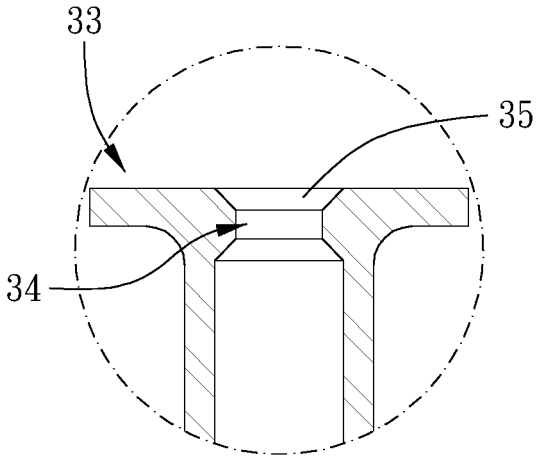
FIG. 7 is a partial enlarged cross-sectional view of a sleeving tube according to an exemplary embodiment of the present invention.
Figure 8:
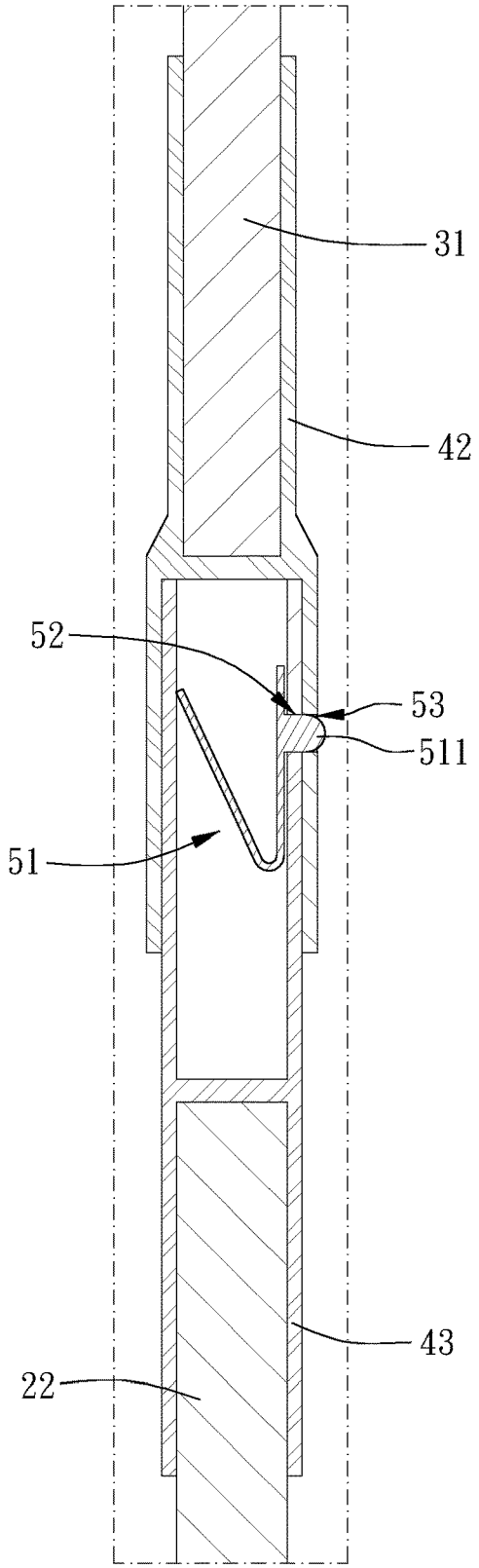
FIG. 8 is another partial enlarged cross-sectional view of an exemplary embodiment of the present invention.
Figure 9:
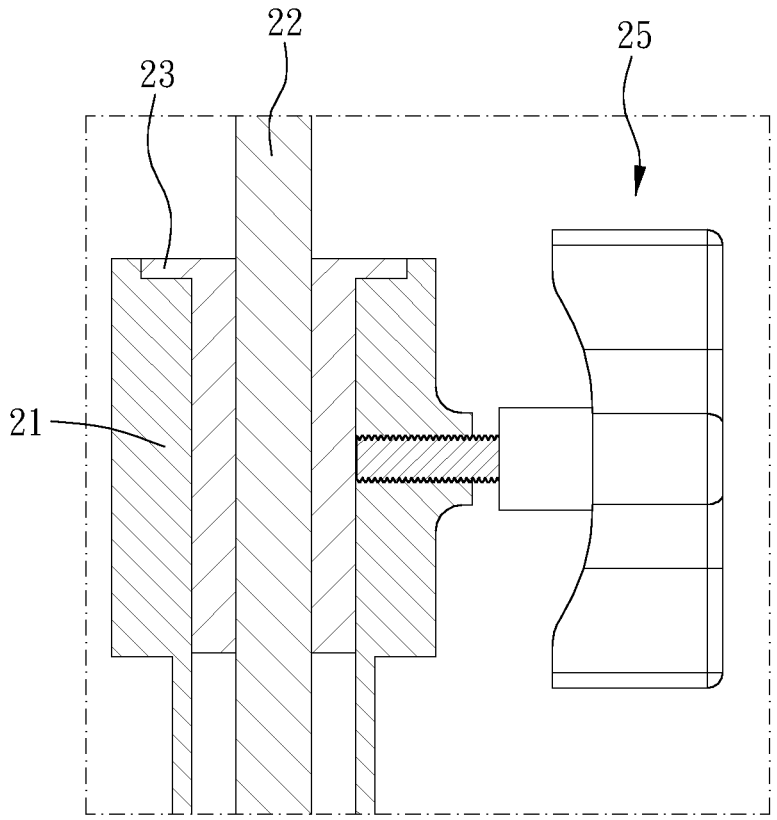
FIG. 9 is another partial enlarged cross-sectional view of an exemplary embodiment of the present invention.

Please refer to FIGS. 1 to 9 for an exemplary embodiment of the present invention. A punching training device of the present invention includes a base 1, a supporting assembly 2 and a punching assembly 3.

The supporting assembly 2 includes a fixed rod 21 and a telescopic rod 22, the fixed rod 21 is uprightly connected to the base 1, the fixed rod 21 is preferably made of metal, the telescopic rod 22 is detachably connected to the fixed rod 21, and the telescopic rod 22 is retractable in an axial direction of the fixed rod 21 the fixed rod 21 relative to, so that it allows to adjust the strike height position and strike angle.

The punching assembly 3 includes an elastic rod 31 and a strike body 32, the elastic rod 31 is detachably connected to the telescopic rod 22, the elastic rod 31 is made of elastic material, and the strike body 32 is disposed on the elastic rod 31. When the strike body 32 is punched, the elastic rod 31 bends and rebounds to simulate actions of the opponent. Compared to the conventional spring, the elastic rod 31 allows a larger range of bending and swinging and provides more effective rebounding movement. For example, the elastic rod 31 is made of glass fiber, which has advantages such as corrosion resistance, insulation, light weight, high modulus of elasticity, and high tensile strength.

Preferably, the length of the elastic rod 31 is at least four times a length of the strike body 32, to have a larger swing after bending under force, and then the strike body 32 can have a wider strike range when it rebounds towards the user.

Preferably, the length of the elastic rod 31 is larger than the length of the telescopic rod 22, which ensures that there is a wider range of force swing and rebound range so it can effectively improve the training intensity.

Preferably, the telescopic rod 22 is made of elastic material, such as glass fiber, so that the telescopic rod 22 can serve as an extension of the elastic rod 31. With the different lengths of the telescopic rod 22 protrusive from the fixed rod 21, the swing fulcrum can be changed, so that the strike body 32 can have different rebound ranges, speeds, heights and drop point ranges, resulting in more variety, and the rebound and counterattack style can fully meet the training requirements.

Specifically, the strike body 32 includes a sleeving tube 33 and a cladding body 36, the cladding body 36 is connected to the sleeving tube 33 by injection molding, and the elastic rod 31 is inserted in the sleeving tube 33 in an insertion direction 6. The cladding body 36 is preferably non-spherical, such as a shape of a fist with a glove to simulate the shape of a real opponent.

Specifically, the punching assembly 3 further includes a fixation member 37 and a first metal tubular member 41, and the first metal tubular member 41 is disposed around an end of the elastic rod 31 remote from the base 1 and located in the sleeving tube 33. In this embodiment, the first metal tubular member is connected to the elastic rod 31 in tight fit The fixation member 37 includes a body portion 371 and a head portion 372 connected to each other, the body portion 371 is screwed to the first metal tubular member 41 in the insertion direction 6, and in the insertion direction 6 the head portion 372 and the sleeving tube 33 overlap with each other to prevent the strike body 32 form disengaging from the elastic rod 31. The structure of the first metal tubular member 41 is strong and wear-resistant, which can effectively withstand the wear and force of the fixation member 37 to ensure the structural integrity of the elastic rod 31.

Preferably, the sleeving tube 33 includes an end opening 34 which is remote from the base and tapered toward the first metal tubular member 41 in the insertion direction 6, and the end opening 34 has a diametric dimension smaller than an outer diametric dimension of the first metal tubular member 41, so that a portion of the sleeving tube 33 around the end opening 34 and the first metal tubular member 41 are blocked with each other in the insertion direction 6. As such, it can effectively position and support the strike body 32 so that it will not disengage along the elastic rod 31.

Preferably, an end of the sleeving tube 33 remote from the base 1 has the end opening 34 which is expanded in the insertion direction 6 and forms a receiving portion 35, the receiving portion 35 receives the head portion 372 of the fixation member 37 so that the head portion 372 will not protrude from the cladding body 36, ensuring that the user will not hit the head portion 372 during training.

Since the elastic rod 31, the telescopic rod 22 and fixed rod 21 are detachable, they can be separated to reduce the maximum length for easy transportation, display and storage. The punching training device further includes a second metal tubular member 42 and a third metal tubular member 43, the second metal tubular member 42 is disposed around an end of the elastic rod 31 adjacent to the telescopic rod 22, and the third metal tubular member 43 is disposed around an end of the telescopic rod 22 remote from the base 1. The second metal tubular member 42 and the third metal tubular member 43 are detachably inserted to each other, which can ensure the long-term use or repeated disassembly and assembly, the wear and force are concentrated on the second metal tubular member 42 and the third metal tubular member 43, so as to maintain the structural integrity of the elastic rod 31 and the telescopic rod 22. The second metal tubular member is connected to the elastic rod 31 in tight fit, and the third metal tubular member is connected to the telescopic rod 22 in tight fit.

Specifically, the punching training device further includes a restriction mechanism 5, and the restriction mechanism 5 includes an elastic buckle 51, a first positioning hole 52 and a second positioning hole 53. One of the second metal tubular member 42 and the third metal tubular member 43 includes the elastic buckle 51 and the first positioning hole 52, and the other of the second metal tubular member 42 and the third metal tubular member 43 includes the second positioning hole 53. A blocking portion 511 of the elastic buckle 51 is protrusive beyond the first positioning hole 52. When the second metal tubular member and the third metal tubular member are inserted to each other, the blocking portion 511 is inserted in the second positioning hole 53 so that the second metal tubular member and the third metal tubular member are restricted in position. This insertion combination allows users to quickly assemble or disassemble.

Specifically, the supporting assembly 2 further includes a sleeve 23 and an urging member 25, the sleeve 23 is at least partially received within the fixed rod 21, and the telescopic rod 22 is disposed through the sleeve 23 and inserted in the fixed rod 21. The sleeve 23 includes a slit 24 extending axially, and the urging member 25 is movably disposed through the fixed rod 21 and abuts the sleeve 23 so that the sleeve 23 secures the telescopic rod 22. In this embodiment, the urging member 25 is screwed to the fixed rod 21. By turning the urging member 25, the tightening force of the sleeve 23 can be changed and adjusted to position or loosen the telescopic rod 22.

Specifically, the sleeve 23 can convert the single-point force from the urging member 25 into a circumferential restraint force, thereby effectively protecting the structural integrity of the telescopic rod 22, and the telescopic rod 22 will not be directly subjected to be urged by the urging member for a long time, avoiding deformation and damage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A punching training device including:

a base;

a supporting assembly including a fixed rod and a telescopic rod, the fixed rod connected to the base, the telescopic rod being detachably connected to the fixed rod, the telescopic rod being retractable in an axial direction of the fixed rod relative to the fixed rod; and a punching assembly including an elastic rod and a strike body, the elastic rod being detachably connected to the telescopic rod, the elastic rod being made of elastic material, the strike body being disposed on the elastic rod;

wherein the punching assembly further includes at least one tubular member which is made of metal, the at least one tubular member is disposed around and detachably connected to an end of the elastic rod adjacent to the telescopic rod and is disposed around and detachably connected to an end of the telescopic rod remote from the base.

2. The punching training device of claim 1, wherein the elastic rod has a length larger than a length of the telescopic rod.

3. The punching training device of claim 1, wherein the strike body includes a sleeving tube and a cladding body, the cladding body is connected to the sleeving tube by injection molding, and the elastic rod is inserted in the sleeving tube in an insertion direction.

4. The punching training device of claim 3, wherein the punching assembly further includes a fixation member and a first metal tubular member, the first metal tubular member is disposed around an end of the elastic rod remote from the base and located in the sleeving tube, the fixation member includes a body portion and a head portion connected to each other, the body portion is screwed to the first metal tubular member in the insertion direction, and in the insertion direction the head portion and the sleeving tube overlap with each other.

5. The punching training device of claim 4, wherein the sleeving tube includes an end opening which is remote from the base and tapered toward the first metal tubular member in the insertion direction, and the end opening has a diametric dimension smaller than an outer diametric dimension of the first metal tubular member, so that a portion of the sleeving tube around the end opening and the first metal tubular member are blocked with each other in the insertion direction.

6. The punching training device of claim 5, wherein the elastic rod has a length larger than a length of the telescopic rod; the telescopic rod is made of elastic material; the supporting assembly further includes a sleeve and an urging member, the sleeve is at least partially received within the fixed rod, the telescopic rod is disposed through the sleeve and inserted in the fixed rod, the sleeve includes a slit extending axially, and the urging member is movably disposed through the fixed rod and abuts the sleeve so that the sleeve secures the telescopic rod; the punching training device further includes a restriction mechanism and the at least one tubular member of the punching assembly further includes a second metal tubular member and a third metal tubular member, the second metal tubular member is disposed around the end of the elastic rod adjacent to the telescopic rod, the third metal tubular member is disposed around the end of the telescopic rod remote from the base, and the second metal tubular member and the third metal tubular member are detachably inserted to each other; the restriction mechanism includes an elastic buckle, a first positioning hole and a second positioning hole, one of the second metal tubular member and the third metal tubular member includes the elastic buckle and the first positioning hole, the other of the second metal tubular member and the third metal tubular member includes the second positioning hole, a blocking portion of the elastic buckle is protrusive beyond the first positioning hole, and when the second metal tubular member and the third metal tubular member are inserted to each other, the blocking portion is inserted in the second positioning hole so that the second metal tubular member and the third metal tubular member are restricted in position; the first metal tubular member is connected to the elastic rod in a first tight fit, the second metal tubular member is connected to the elastic rod in a second tight fit, and the third metal tubular member is connected to the telescopic rod in a third tight fit; the elastic rod is made of glass fiber, and the telescopic rod is made of glass fiber; an end of the sleeving tube remote from the base has the end opening which is expanded in the insertion direction and forms a receiving portion, and the receiving portion receives the head portion of the fixation member; the length of the elastic rod is at least four times a length of the strike body; and the cladding body is non-spherical.

7. The punching training device of claim 4, wherein the at least one tubular member of the punching assembly includes a second metal tubular member and a third metal tubular member, the second metal tubular member is disposed around an the end of the elastic rod adjacent to the telescopic rod, the third metal tubular member is disposed around the end of the telescopic rod remote from the base, and the second metal tubular member and the third metal tubular member are detachably inserted to each other.

8. The punching training device of claim 7, further including a restriction mechanism, wherein the restriction mechanism includes an elastic buckle, a first positioning hole and a second positioning hole, one of the second metal tubular member and the third metal tubular member includes the elastic buckle and the first positioning hole, the other of the second metal tubular member and the third metal tubular member includes the second positioning hole, a blocking portion of the elastic buckle is protrusive beyond the first positioning hole, and when the second metal tubular member and the third metal tubular member are inserted to each other, the blocking portion is inserted in the second positioning hole so that the second metal tubular member and the third metal tubular member are restricted in position.

9. The punching training device of claim 1, wherein the telescopic rod is made of elastic material.

10. The punching training device of claim 1, wherein the supporting assembly further includes a sleeve and an urging member, the sleeve is at least partially received within the fixed rod, the telescopic rod is disposed through the sleeve and inserted in the fixed rod, the sleeve includes a slit extending axially, and the urging member is movably disposed through the fixed rod and abuts the sleeve so that the sleeve secures the telescopic rod.

* * * * *